United States Patent [19]

Hart

[11] Patent Number: 4,521,045

[45] Date of Patent: Jun. 4, 1985

[54] MATTRESS CARRIER

[76] Inventor: Cecil C. Hart, 108 Pine Acres Dr., Spartanburg, S.C. 29302

[21] Appl. No.: 529,095

[22] Filed: Sep. 2, 1983

[51] Int. Cl.[3] ..... B65D 65/00

[52] U.S. Cl. ..... 294/149; 383/16; 383/17; 383/24; 294/152

[58] Field of Search ..... 294/74, 77, 137, 138, 294/149, 152, 155–157; 16/DIG. 28; 150/52 R; 383/6, 16–18, 24, 97

[56] References Cited

U.S. PATENT DOCUMENTS

| | | | |
|---|---|---|---|
| 604,043 | 5/1898 | Hall . | |
| 616,249 | 12/1898 | Nickerson | 383/16 |
| 1,233,784 | 7/1917 | Hutchison | 383/16 X |
| 1,579,420 | 4/1926 | Welch . | |
| 1,731,530 | 10/1929 | Goldeen et al. | 294/149 X |
| 2,279,886 | 4/1942 | Fuchs | 150/52 R X |
| 2,611,910 | 9/1952 | Bell | 5/351 |
| 2,761,480 | 9/1956 | Tames | 383/16 |
| 3,128,854 | 4/1964 | Specht | 383/18 X |
| 3,136,429 | 6/1964 | Kleinschmidt . | |
| 3,214,072 | 10/1965 | Brown . | |
| 3,950,800 | 4/1976 | Garshfield . | |
| 4,054,166 | 10/1977 | Burke . | |
| 4,062,392 | 12/1977 | Ishii | 383/16 X |
| 4,119,250 | 10/1978 | Brutlag | 294/149 |
| 4,388,738 | 6/1983 | Wagner . | |
| 4,431,226 | 2/1984 | Weilert | 294/152 |

*Primary Examiner*—Johnny D. Cherry
*Attorney, Agent, or Firm*—Luke J. Wilburn, Jr.

[57] ABSTRACT

An improved mattress carrier for containing and protectably enclosing a mattress and for facilitating handling of the mattress during transportation to a location of use. The carrier comprises a flexible, generally rectangular cover designed to receive and contain a mattress therein. The cover has an upper zippered opening, sets of reinforcing straps bands and spaced pairs of handles on opposite ends of the cover to be gripped by respective deliverymen to normally support the mattress in a generally vertical plane. The handles which may be formed by flexible looped ends of the reinforcing bands are spaced along the ends of the cover on opposite sides of a midline of the mattress carrier, such that the mattress and carrier may be easily manipulated and reoriented about the midline in confined spaces to facilitate handling of the same.

4 Claims, 3 Drawing Figures

MATTRESS CARRIER

This invention relates to an improved mattress carrier and, more particularly, to a mattress carrier construction which protects a mattress and facilitates its handling during delivery and installation of the same in a location of use.

BACKGROUND OF THE INVENTION:

Difficulties often are experienced by furniture store and moving van line personnel in handling bed mattresses during delivery and installation in a location of use. Not only are the mattresses susceptible to damage and soiling during delivery, but oversized mattresses, especially king and queen sizes, are bulky, cumbersome and generally require two persons to effectively carry and install the same in the bedroom location of the home.

It is a practice in certain mattress constructions to provide handles or grips sewn into the sides of the mattresses to facilitate carrying and handling of the same; however, with large heavy oversize mattresses, the weight and bulk of the same often results in the handles tearing out of the mattress construction.

To facilitate transportation and handling of mattresses, carrying devices have been suggested and certain of these are disclosed in prior art patents. U.S. Pat. No. 4,119,250 discloses a mattress carrying device consisting of a cloth-like pocket for receiving an edge of a mattress, with two flexible straps which may be gripped by a person at each end of the mattress to carry the same. U.S. Pat. No. 3,136,429 discloses a mattress carrier consisting of a wooden frame having a base, side supports, and wheels for rolling the frame along a support surface. U.S. Pat. No. 3,214,072 discloses a mattress carrying sling consisting of flexible hand engageable straps joined at a center portion which is inserted for support under the bottom edge of the mattress. U.S. Pat. No. 1,579,420 discloses a mattress carrying strap which has handles and encircles an end of a rolled mattress to facilitate carrying of the same. U.S. Pat. No. 604,043 discloses a mattress having two straps surrounding opposite end portions of the same and provided with handles to facilitate handling and turning of the mattress.

BRIEF OBJECTS OF THE INVENTION

It is an object of the present invention to provide an improved mattress carrier which protects the mattress and facilitates the handling and delivery of the same to a location of use.

It is a more specific object to provide a mattress carrier which serves as a protective cover to avoid soiling and damage of mattresses during delivery, and which is provided with carrying handles located at spaced locations on end portions of the carrier to facilitate handling of the same by workmen during delivery to locations of use.

It is a further object to provide an improved mattress carrier which particularly facilitates the protection and handling of large and heavy mattresses, such as king and queen size mattresses, and which may be conveniently stored in compact condition when not in use.

BRIEF DESCRIPTION OF THE DRAWINGS

The above, as well as other objects of the present invention will become more apparent from the following detailed description of a preferred embodiment thereof, when taken in connection with the accompanying drawing, in which.

SUMMARY OF THE INVENTION

The improved mattress carrier of the present invention comprises a flexible clothlike cover of generally rectangular construction which completely encloses and protects a mattress against soiling and damage during delivery. The cover is provided with three sets of spaced reinforcing bands which extend horizontally across an upper portion of the cover and diagonally across lower corners of the same, respectively. Loops at the ends of the bands form flexible handles, pairs of which are located in vertically spaced relation at opposite ends of the mattress carrier. Each pair of spaced handles at each end of the carrier is gripped by a delivery person to effectively balance and control the position of the mattress during its upright carry, while facilitating manipulation and reorientation of the mattress around and through confined spaces. The mattress cover is zippered about three side edges of its periphery to facilitate easy insertion and removal of the mattress therefrom. The carrier is particularly suited for protecting and handling large mattress constructions, such as king and queen size mattresses, during delivery from a furniture store or in moving van line operations to a point of use.

DETAILED DESCRIPTION OF PREFERRED EMBODIMENT OF THE INVENTION

Figure 1:
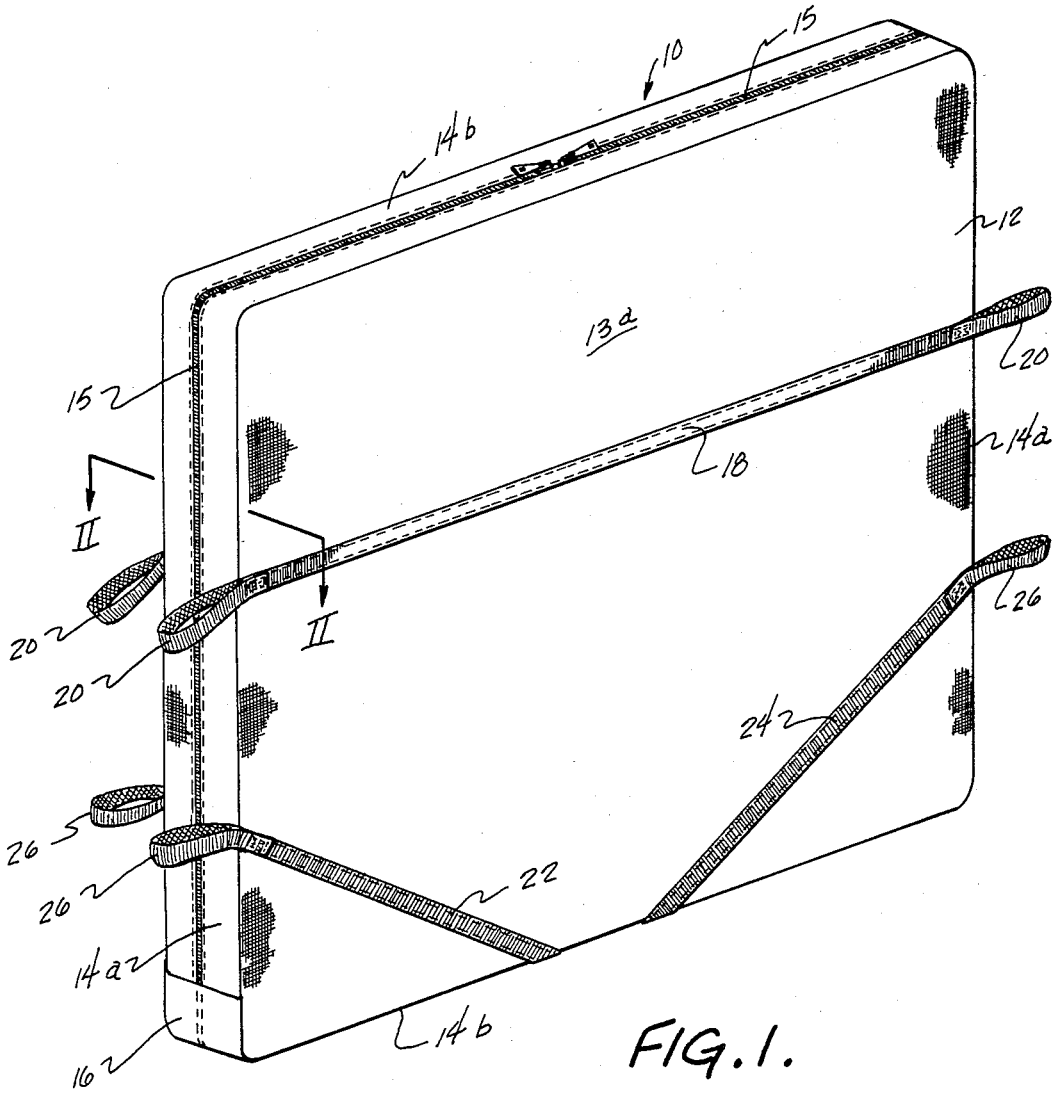
FIG. 1 is a perspective view of a mattress carrier of the present invention.
Figure 2:
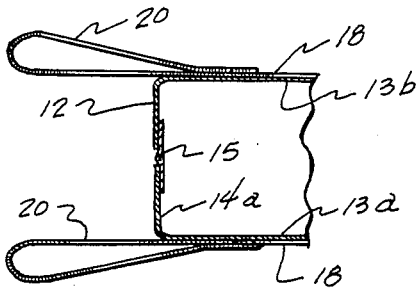
FIG. 2 is a partial sectional view of an end portion of the cover taken along line II—II of FIG. 1, showing the arrangement of one set of carrying handles of the mattress carrier.
Figure 3:
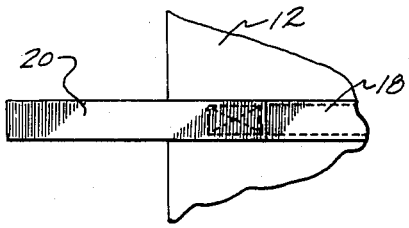
FIG. 3 is a sectional side elevation view of the upper left-hand handle means of the mattress carrier of FIG. 1, showing in more detail the attachment of a reinforcing band and a carrying handle of the same.

As seen in FIGS. 1–3 of the drawings, the improved mattress carrier 10 of the present invention comprises a flexible cover 12 of generally rectangular shape having opposed sides 13*a*, 13*b*, and two pairs of opposed end panels 14*a* and 14*b*, dimensioned to receive and completely enclose a king size mattress therein. The cover is provided with a pair of heavy duty zippers 15 extending along the midline of three of the end panels of the periphery of the cover to closely contain and enclose a mattress to be delivered to a location of use. The cover may be formed of a heavy duty cloth or plastic sheet material, such as a woven cotton canvas.

As seen in FIG. 1, each of the lower portions of the opposed end panels 14*a* of the carrier are oversewn with a reinforcing pocket 16 which overlies the end of each of the zippers 15 to protect the same and to further reinforce the cover aginst the weight of the mattress in its normal vertical position of carry.

As seen in FIGS. 1 and 2, extending horizontally across the mattress cover 12 above the longitudinal mid-line of the same are a set of two reinforcing bands 18, each of which is sewn in opposed relation to an opposite side 13*a*, 13*b*, of the cover. The ends of each band 18 at each end 14*a* of cover 12 are looped and sewn back upon themselves (note FIGS. 2 and 3) to form a pair of flexible carrying handles 20.

As best seen in FIG. 1, extending diagonally across the lower corners of each side of the mattress cover are second and third sets of two reinforcing bands 22,24 which are sewn in opposed relation to the sides 13*a*, 13*b* of the cover. The lower ends of the sets of diagonal bands 22, 24 extend from the bottom central edge portion of the mattress cover at an angle of about 35° from the bottom edge and the upper ends of the bands terminate in loops which form second pairs of handles 26 at the ends of the cover spaced from the first handles 20.

Typically, the carrier cover 12 may be constructed to accommodate a king size mattress which has general side dimensions of 80 inches by 82 inches and a 7 inch end panel thickness. The reinforcing bands 18,22,24 may be of 2 inch wide woven nylon. Handles 20 of reinforcing bands 18 preferably are located about $\frac{1}{3}$ of the length of the ends 14*a* down from the top edge of the mattress cover, while the handles 26 of the diagonal bands 22, 24 are preferably located approximately $\frac{1}{3}$ the length of the ends 14*a* up from the bottom edge of the cover, as seen in FIG. 1. The loop handles 20, 26 of the mattress carrier may be about 10 inches in length to be conveniently gripped by the two hands of a deliveryman at each end of the mattress to carry the same.

The location of the upper and lower handle pairs 20, 26 at opposite ends of the cover are spaced on opposite sides of a midpoint of the length of the ends 14*a* of the cover, as viewed in FIG. 1, and the handles divide the vertical side edges of the carrier cover into approximately three equal sections of length. The handles are thus in a position to be readily grasped by the two hands of a workman at each end of the mattress cover, and their positions on opposite sides of the midpoint of the length of the ends facilitate pivotal reorientation of the mattress about its centerline during its movement through confined areas.

The diagonal bands 22, 24 of the mattress carrier which extend from the central portion of the lower edge 14*b* of the cover strengthen the cover and particularly distribute the major lifting stress forces of the handles 26 at an angle downwardly toward the central bottom portion of the cover to provide improved support to the middle portion of the mattress during its transportation. The mattress carrier may be readily folded and stored in compact condition when not in use.

Although the embodiment of the carrier of the present invention has been described as particularly sized to protect and facilitate handling of king size mattresses, it may also be used to transport queen size or even double bed size mattresses therein. The dimensions of the mattress carrier obviously may be reduced and sized to particularly accommodate a queen size or smaller size mattresses, if desired, without departing from the scope of the present invention.

That which is claimed is:

1. An improved mattress carrier for protecting a mattress and facilitating its handling during delivery to a point of use comprising a flexible, generally rectangular cover having an opening for receiving and protectively enclosing a mattress therein, means for closing the opening to contain the mattress within the cover, a pair of hand-engageable handle means attached to each of a pair of opposite ends of the cover and located in spaced relation on opposite sides of a mid-point of the length of said opposite ends for lifting and manipulating the carrier during transportation of a mattress therein, a first set of reinforcing bands of flexible material attached to and extending in opposed relation to each other along opposite sides of the cover generally perpendicular to said opposite ends of the cover, the ends of each of said first set of bands terminating in loops which comprise a first of said pair of hand-engageable handle means at each end of the cover, and second and third sets of reinforcing bands respectively attached to and extending in opposed relation diagonally across adjacent lower corners of opposite sides of the cover, the ends of each of said second and third sets of bands terminating in loops which comprise the second of said pair of hand-engageable handle means, whereby the spaced pairs of handle means at each of said opposite ends of the cover may be engaged by a workman to carry a mattress within the carrier.

2. A mattress carrier as defined in claim 1 wherein the opening in the cover for receiving the mattress extends along three of the four side edges of the rectangular cover and said means for closing the opening comprises a pair of zippers the ends of which terminate in lower corners of the cover, and means overlying said ends of the zippers to protectively cover the same and reinforce the cover at its corners.

3. A mattress carrier as defined in claim 1 wherein said cover is comprised of a woven fabric material and said reinforced bands are comprised of woven material of high strength yarns.

4. An improved mattress carrier for protecting a mattress and facilitating its handling during delivery to a point of use comprising a generally rectangular cover composed of flexible material and having an opening for receiving and protectively enclosing a mattress therein, means for closing the opening to contain the mattress within the cover, and reinforcing bands of material attached to opposite sides of the cover to reinforce and strengthen the same, a first set of said bands attached to opposite sides of the cover and extending parallel to one pair of opposed parallel side edges of the cover and located on one side of a parallel mid-line of the cover, second and third sets of reinforcing bands attached to said opposite sides of the cover and extending diagonally across corners of the rectangular cover on the other side of said mid-line of the cover from said first set of reinforcing bands, each of said reinforcing bands having end portions forming loops serving as handle means extending from the other pair of opposed side edges of the cover, the loops of said first set of reinforcing bands being spaced along the length of said other pair of opposed side edges from the loops of said second and third sets of reinforcing bands, whereby the loops forming handle means may be grasped by a workman at each end of the mattress carrier to lift and transport the same, and may be manipulated by the workmen to orient the mattress cover about the mid-line of the cover during handling.

* * * * *